US008921298B2

(12) United States Patent
Tyborski

(10) Patent No.: US 8,921,298 B2
(45) Date of Patent: Dec. 30, 2014

(54) ACIDIC CLEANER FOR METAL SURFACES

(75) Inventor: Thomas Tyborski, Düsseldorf (DE)

(73) Assignee: Ecolab USA Inc., St. Paul, MN (US)

( * ) Notice: Subject to any disclaimer, the term of this patent is extended or adjusted under 35 U.S.C. 154(b) by 1691 days.

(21) Appl. No.: 12/300,064

(22) PCT Filed: May 8, 2006

(86) PCT No.: PCT/EP2006/062138

§ 371 (c)(1),
(2), (4) Date: Aug. 9, 2010

(87) PCT Pub. No.: WO2007/128345

PCT Pub. Date: Nov. 15, 2007

(65) Prior Publication Data

US 2010/0294307 A1 Nov. 25, 2010

(51) Int. Cl.

| | |
|---|---|
| ***C11D 1/34*** | (2006.01) |
| ***C23G 1/08*** | (2006.01) |
| ***C11D 1/37*** | (2006.01) |
| ***C11D 1/83*** | (2006.01) |
| ***C11D 3/00*** | (2006.01) |
| ***C11D 3/04*** | (2006.01) |
| ***C11D 3/12*** | (2006.01) |
| ***C11D 3/20*** | (2006.01) |
| ***C11D 3/28*** | (2006.01) |
| ***C11D 3/36*** | (2006.01) |
| ***C11D 11/00*** | (2006.01) |
| ***C23G 1/10*** | (2006.01) |
| ***C23G 1/12*** | (2006.01) |
| *C11D 1/78* | (2006.01) |

(52) U.S. Cl.

CPC *C23G 1/083* (2013.01); *C11D 1/78* (2013.01); *C11D 1/342* (2013.01); *C11D 1/345* (2013.01); *C11D 1/37* (2013.01); *C11D 1/83* (2013.01); *C11D 3/0073* (2013.01); *C11D 3/042* (2013.01); *C11D 3/044* (2013.01); *C11D 3/1213* (2013.01); *C11D 3/122* (2013.01); *C11D 3/2075* (2013.01); *C11D 3/28* (2013.01); *C11D 3/361* (2013.01); *C11D 11/0029* (2013.01); *C23G 1/10* (2013.01); *C23G 1/103* (2013.01); *C23G 1/125* (2013.01)

USPC ..... 510/245; 510/467

(58) Field of Classification Search

CPC ..... C11D 3/0073; C11D 1/345; C11D 1/342; C11D 1/78; C11D 11/0029

USPC ..... 510/245, 467

See application file for complete search history.

(56) References Cited

U.S. PATENT DOCUMENTS

| | | | | |
|---|---|---|---|---|
| 4,246,103 | A * | 1/1981 | Block et al. | 210/699 |
| 5,152,403 | A * | 10/1992 | Patel | 210/699 |
| 6,251,847 | B1 | 6/2001 | Pierce et al. | |
| 6,472,358 | B1 | 10/2002 | Richter et al. | |
| 6,780,824 | B2 * | 8/2004 | Oelscher et al. | 508/431 |
| 2003/0087770 | A1 * | 5/2003 | Oelscher et al. | 508/280 |
| 2007/0235061 | A1 * | 10/2007 | Mizuta et al. | 134/2 |
| 2007/0244028 | A1 * | 10/2007 | Schirmer-Ditze et al. | 510/500 |
| 2008/0261852 | A1 * | 10/2008 | Schirmer-Ditze et al. | 510/311 |
| 2009/0075857 | A1 * | 3/2009 | Jonke et al. | 510/337 |

FOREIGN PATENT DOCUMENTS

| | | |
|---|---|---|
| WO | WO 91/18080 | 11/1991 |
| WO | WO02/068488 | 9/2002 |

* cited by examiner

*Primary Examiner* — Gregory Webb

(74) *Attorney, Agent, or Firm* — Merchant & Gould P.C.

(57) ABSTRACT

The invention relates to a acidic composition for cleaning surfaces of metal or alloys which are susceptible to corrosion comprising i) an ester of phosphoric acid, diphosphoric acid or polyphosphoric acid, ii) a benzotriazole derivative of the general formula (I)

(I)

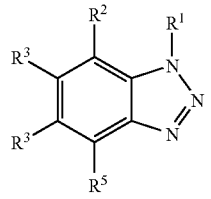

in which each of the groups $R^1$, $R^2$, $R^3$, $R^4$ and $R^5$ is the same or different and is hydrogen atom, an alkyl group, an alkenyl group, or an acyl group, iii) a phosphonic acid of the general formula $R^6$—PO—$(OH)_2$ (II) in which the group $R^6$ is alkyl group, alkenyl group, aryl group, or arylalkyl group and iv) an acidic source.

The invention further relates to a use solution and to a method for cleaning.

17 Claims, No Drawings

ACIDIC CLEANER FOR METAL SURFACES

The present invention relates to an acidic composition for cleaning surfaces of metal or alloys of metal which are susceptible to corrosion. The invention further relates to an aqueous acidic use solution which is made from the composition, and to a method of cleaning metal surfaces by using this aqueous use solution.

Periodic cleaning of manufacturing or processing machines in food, drink, pharmaceutical, cosmetic and similar processing industries as well as in food preparation and service businesses, in health and day care facilities and in hospitality establishments is necessary to keep product quality and public health. Residues which are left on the equipment surfaces or which may contaminate the food which is processed can harbor and nourish growth of subsequent processed products or critical contact surfaces.

This practice of cleaning is particularly important in food processing facilities to avoid a contamination of the food and to keep the product quality of the produced food product.

A lot of facilities which have to be cleaned are objects comprising at least parts made of metal or alloys which are susceptible to corrosion when getting into contact with highly acidic or alkaline cleaning liquids.

Especially all metals having a negative standard potential show corrosion if acidic cleaning agents containing strong acids are used. Examples of these metals are tin, ion, aluminum, zinc, lead, cadmium, magnesium and alloys from these metals, also galvanized metals like for example zinc plated steel corrode when acids are used and the galvanized surface is destroyed.

Acidic cleaners are often used if the water has a high hardness because in these cases alkaline cleaners react with the calcium ions in the water and build up layers of calcium salts. These layers of calcium salts are difficult to remove.

DE 100 36 607 A1 describes an acidic cleaning composition containing an acid selected from phosphoric acid, alkyl sulfonic acid, sulfuric acid and nitric acid. Furthermore, the composition contains undecanoic acid.

The composition is used for the cleaning or disinfection of hard surfaces.

A further acidic sanitizing and cleaning composition is described in U.S. Pat. No. 6,472,358. The reference describes a sanitizing composition containing aliphatic short chain $C_5$-$C_{14}$ fatty acids or a mixture thereof, a weak carboxylic acid and a strong mineral acid which may be nitric acid or a mixture of nitric and phosphoric acids.

Furthermore, in the state of the art products are used for the cleaning of zinc galvanized steel containing phosphoric acid as an acid source together with quaternary ammonium compounds, sulfur-organic substances and metal organic substances. By using these substances in addition to the acid in a composition, corrosion of the zinc surface of the galvanized steel is avoided. However, there are several disadvantages of this kind of products. For example, the quaternary ammonium compounds form black blue tenacious layers on the treated metal surfaces. The removal of these layers is very difficult and the layers are critical especially in food producing plants because they may contaminate the processed food. Furthermore, metal organic as well as sulfur-organic substances are critical because of environmental and waste water reasons. Furthermore, their toxicological profile shows that they are not readily biodegradable.

Therefore, it is the technical object of the present invention to provide an acidic cleaning composition with a corrosion inhibitory effect on metal surfaces or alloy surfaces, which avoids the use of compounds having a critical toxicological profile and which does not form any layers on the treated surfaces.

Furthermore, the used compounds in the composition should be biodegradable because of environmental and waste water reasons.

This technical problem is solved by an acidic composition for cleaning surfaces of metal or alloys comprising (i) an ester of phosphoric acid, diphosphoric acid or polyphosphoric acid, (ii) a benzotriazole derivative of the general formula (I)

(I)

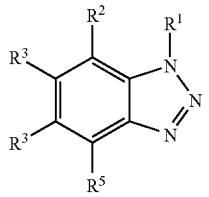

in which each of the groups $R^1$, $R^2$, $R^3$, $R^4$ and $R^5$ is the same or different and is hydrogen atom, an alkyl group, an alkenyl group or an acyl group and (iii) a phosphonic acid of the general formula $R^6$—PO—$(OH)_2$ (II) in which the group $R^6$ is alkyl group, alkenyl group, aryl group, or arylalkyl group, and (iv) an acidic source.

In a preferred embodiment the acidic composition is an aqueous acidic composition.

The expression "ester" as used throughout the specification has to be understood as being a monoester, a diester, a triester or a polyester or mixtures of these esters in different ratios.

In a preferred embodiment the composition contains as an aqueous liquid composition (i) 0.1 to 10%, preferably 1 to 3 wt. % of the ester of phosphoric acid, diphosphoric acid or polyphosphoric acid, (ii) 0.01 to 2 wt. %, preferably 0.05 to 0.5 wt. % of the benzotriazole derivative according to formula (I), (iii) 0.01 to 2 wt. %, preferably 0.05 to 0.5 wt. % of the phosphonic acid and (iv) 10 to 70 wt. %, preferably 30 to 50 wt. % of the acidic source.

In a preferred embodiment, the ester of phosphoric acid is a monoester and/or diester of phosphoric acid, preferably, the ester is a monoalkylester and/or dialkylester of phosphoric acid and most preferred the ester is a mono $C_4$-$C_{15}$ alkylester and/or a di $C_4$-$C_{15}$ alkylester of phosphoric acid. Preferably the ester group in the mono- and the dialkylester of phosphoric acid is a $C_6$-$C_{13}$ alkyl group.

In the benzotriazole derivative of the general formula (I) each of the groups $R^1$, $R^2$, $R^2$, $R^3$, $R^4$ and $R^5$ is the same or different and in a preferred embodiment these groups are hydrogen atom or a $C_1$-$C_4$ alkyl group. Most preferred the benzotriazole derivative is a derivative according to general formula (I) in which $R^1$-$R^6$ is hydrogen atom.

The phosphonic acid of general formula (II) is an acid in which preferably the group $R^6$ is a $C_5$-$C_{12}$ alkyl group.

As an additional component a calcium compound can be present in the composition. If a calcium compound is present in the composition, it is preferably selected from the group consisting of calcium chloride, calcium bromide, calcium acetate, calcium hydroxide, calcium oxide or mixtures thereof.

In a further preferred embodiment the composition can in addition comprise a magnesium compound. If the composition comprises a magnesium compound it is preferably selected from the group consisting of magnesium chloride, magnesium bromide, magnesium acetate, magnesium sulfate, magnesium hydroxide, magnesium oxide or mixtures thereof.

The acidic source in the composition is preferably an organic or inorganic acid or a mixture thereof. In a preferred embodiment, the acid is selected from the group consisting of phosphoric acid, citric acid, hydrochloric acid, sulfuric acid, nitric acid, acetic acid or peroxycarboxylic acid.

As mentioned above, the use of toxicological critical substances should be avoided in the composition according to the invention. In a preferred embodiment, the composition contains less than 100 ppm metal organic substances, preferably no metal organic substances. Furthermore, it is preferred that the composition contains less than 100 ppm quaternary ammonium compounds, preferably no quaternary ammonium compounds. In a further embodiment the composition contains less than 100 ppm sulfur organic substances, preferably the composition does not contain any sulfur organic substances.

The pH of the composition according to the invention is preferably lower than 3, most preferably lower than 2.

As can be seen from the examples according to the invention and the comparative examples in the experimental part of the specification, the combination of the ester of phosphoric acid, the benzotriazole derivative and the phosphonic acid show less weight loss of the zinc layer on the galvanized steel and no visual changes compared to the compounds according to the state of the art, while the cleaning effect is identical.

The composition according to the invention can be used on different metals like zinc galvanized steel, aluminum, brass, stainless steel and copper.

The composition according to the invention may further comprise other components typically used in an acidic cleaning composition like sequestrants, surfactants, disinfectants, bleaching agents, oxidants, builders, solubilizers, solvents or mixtures thereof, defoamers, cutlers, chelating agents, dyes, fragrances, rheology modifiers, manufacturing process aids, other corrosion inhibitors, preserving agents, buffers, tracers, inert fillers, solidifying agents and antimicrobials.

Appropriate sequestering agents can be exemplified by ethylene diaminetetraacetic acid, nitrilo triacetic acid, phosphates in particular polyphosp h-sates such as pentasodium triphosphate, polyhydroxycarboxylic acids, citrates, in particular alkali citrates, dimercaprol, triethanol amine, crown compounds or phosphonoalkane polycarboxylic acids.

The phosphonoalkane polycarboxylic acids preferably comprise a straight chain hydrocarbon backbone having 3 to 6 carbon atoms and 2 to 5 carboxylic acid moieties. An especially preferred phosphonoalkane polycarboxylic acid represents 2-phosphonobutane-1,2,4-tricarboxylic acid. Those compounds are particularly advantageous in combination with calcium or magnesium compounds. The sequestering agent should be contained in the composition in a total amount of from 2 to 35 wt. %, preferably of from 5 to 25 wt. % and most preferred of from 9 to 20 wt. % based on the total composition in order to obtain a sufficient sequestering performance.

Surfactants may also be optionally added to the compositions of the present invention for a variety of reasons including improved surface wetting by lowering the surface tension, improved soil or biofilm penetration, removal and suspension of organic soils, enhancement of biocidal effects, characterization of foam profile etc. The surfactants useful herein include non-ionic, anionic and cationic surfactants, most suitably the surfactants employed include water soluble or water dispersible anionic or non-ionic surfactants or combinations thereof.

Useful anionic surfactants include, but are not limited to, those compounds having an hydrophobic group of $C_6$-$C_{22}$ such as alkyl, alkylaryl, alkenyl, acyl, long chain hydroxyalkyl, alkoxylated derivatives thereof and so forth, and at least one water-solubilizing group of acid or salt form derived from sulfonic acid, sulfuric acid ester, phosphoric acid ester and carboxylic acid. The salt may be selected based on the specific formulation to which it is being added.

More suitably, the anionic surfactants useful herein include, but are not limited to, sulfonated anionics such as alkyl sulfonates or disulfonates, alkyl aryl sulfonates, alkyl naphthalene sulfonates, alkyl diphenyl oxide disulfonates, and so forth.

More particularly, the anionic surfactants more suitable for use herein include, but are not limited to, those anionic surfactants which are linear or branched C6-C14 alkylbenzene sulfonates, alkyl naphthalen sulfonates, long chain alkene sulfonates, long chain hydroxyalkane sulfonates, alkane sulfonates and the corresponding disulfonates including 1-octane sulfonate and 1,2-octane disulfonate, alkyl sulfates, alkyl poly(ethyleneoxy)ether sulfates and aromatic poly(ethyleneoxy) sulfates such as the sulfates or condensation products of ethylene oxide and nonyl phenol, having 1 to 6 oxyethylene groups per molecule, other sulfonated surfactants, and so forth.

Specific examples of anionic surfactants suitable for use herein include alkyl sulfonates such as 1-octane sulfonate commercially available from a variety of including Stepan Co. in Northfield, Ill. under the tradename of BIO-TERGE(R) PAS-8; PILOT(R) L-45, a C11.5 alkylbenzene sulfonate (referred to as "LAS") from Pilot Chemical Co.; BIOSOFT(R) S100 and S130, non-neutralized linear alkylbenzene sulfonic acids (referred to as "HLAS"), and S40, also an LAS, all from Stepan Company; DOWFAX(R) anionic alkylated diphenyl oxide disulfonate (ADPODS) surfactants available from Dow Chemical Co. including C-6 (45% and 78%); C2-C18 alkyl naphthalene sulfonates such as those available from Petro-Chemicals Co. under the tradename of PETRO(R) including the liquid PETRO(R) LBA; and so forth.

Examples of nonionic surfactants useful in the compositions of the present invention include, but are not limited to, the following classes:

1) polyoxypropylene-polyoxylethylene block polymers including those made from propoxylation and/or ethoxylation of an initiator hydrogen compound such as propylene glycol, ethylene glycol, glycerol, trimethylolpropane, ethylenediamine, and so forth such as those sold under the tradename of PLURONIC(R) and TETRONIC(R) available from BASF Corp.;

2) condensation products of one mole of $C_8$ to $C_{18}$ branched or straight chain alkyl or dialkyl phenol with about 3 to about 50 moles of ethylene oxide such as those sold under the tradename of IGEPAL(R) available from Rhone-Poulenc and TRITON(R) available from Union Carbide.

3) condensation products of one mole of a saturated or unsaturated, branched or straight $C_6$ to $C_{24}$ alcohols with about 3 to about 50 moles of ethylene oxide such as those sold under the tradename of NEODOL(R) available from Shell Chemical Co. and ALFONIC(R) available from Condea Vista Co.;

4) condensation products of one mole of saturated or unsaturated, branched or straight chain $C_8$ to $C_{18}$ carboxylic acids with about 6 to about 50 moles of ethylene oxide such as those available under the tradename of NOPALCOL(R) from Henkel Corp. and LIPOPEG(R) from Lipo Chemicals, Inc.; and other alkanoic esters formed by condensation of carboxylic acids with glycerides, glycerin, and polyhydric alcohols;

5) surfactants produced by the sequential addition of ethylene oxide and propylene oxide to ethylene glycol, ethylenediamine which result in a hydrophile with hydrophobic blocks (i.e. propylene oxide) at the terminal ends (the hydrophilic and hydrophobic blocks are reversed) of each molecule weighing from about 1,000 to about 3,100 and the central hydrophile being about 10 wt-% to about 80 wt-% of the final molecule such as the PLURONIC(R)R surfactants and the TETRONIC(R)R (ethylene oxide and propylene oxide with ethylenediamine) surfactants also available from BASF Corp.; and 6) compounds from (1), (2), (3) and (4) modified by "capping" or "end blocking" the terminal hydroxy group or groups by reaction with small hydrophobic molecules such as propylene oxide, butylene oxide, benzyl chloride, short chain fatty acids, alcohols or alkyl halides containing from 1 to about 5 carbon atoms, converting terminal hydroxy groups to chloride with thionyl chloride, and so forth leading to all-block, block-heteric, heteric-block or all-heteric nonionics.

More suitably, the nonionics useful herein include, but are not limited to, amine oxides, block copolymers of ethylene oxide and propylene oxide sequentially condensed upon initiators having difunctional or tetrafunctional reactive hydrogens and alcohol alkoxylates. Especially preferred surfactants for compositions of the present invention are mixtures of alkyl sulfonates and block copolymers of ethylene oxide and propylene oxide sequentially condensed onto an ethylenediamine initiator.

A blend of surfactants may be suitably employed in the present invention to arrive at the characteristics desirable for a particular application. For instance, some embodiments may include a surfactant for emulsification, a surfactant for soil removal, i.e. detersive surfactants, and so forth. Some embodiments may include the addition of a low foaming nonionic surfactants which have been found to be beneficial because they do not generate unwanted foam, do not interfere with antimicrobial activity, further solubilize otherwise insoluble or phase unstable fatty acids, and provide improved surface wetting a solid penetration properties. Therefore, a blend of surfactants may be desirable. This part of the composition may therefore be referred to as the surfactant component to accurately reflect the fact that a single surfactant may be utilized in the compositions of the present invention, or a blend including two or more surfactants may be utilized in the present invention. The surfactant component is generally useful from 0 wt-% to about 50 wt-% of the concentrate, suitably about 0.1 wt-% to about 50 wt-%, more suitably about 0.25 wt-% to about 45 wt-%, even more suitably about 0.5 wt-% to about 40 wt-%, and most suitably about 1 wt-% to about 30 wt-% of the concentrate.

Taking the above description into account depending on the kind of soil and the form and location of the metal surface to be cleaned it may be either possible to use a foaming cleaner or a non-foaming cleaner wherein the non-foaming may be achieved by completely omitting any kind of surfactant or by using low-foaming surfactants.

In order to obtain a homogenous solution from the above composition it may be helpful to further add one or more solubilizers. In particular they facilitate the dispersion of organic components such as the one or more surfactants in the aqueous solution. Suitable solubilizers are exemplified by sodium, potassium, ammonium and alkanol ammonium salts of sulfonates of xylene, toluene, ethylbenzoate, isopropylbenzene, naphthalene or alkyl naphthalene, phosphate esters of alkoxylated alkyl phenols, phosphate esters of alkoxylated alcohols and sodium, potassium and ammonium salts of alkyl sarcosinates, as well as mixtures thereof.

In a preferred embodiment the one or more solubilizers are contained in the composition in a total amount of from 1 to 35 wt. %, preferably of from 5 to 25 wt. % and more preferred of from 9 to 20 wt. %.

The composition according to the present invention may additionally contain one or more other compounds commonly used in cleaning compositions like ones selected from the group comprising disinfectants, builder substances, solvents and bleaching agents. Those compounds preferably are contained in the composition according to the invention in a total amount of from 0 to 20 wt. %, preferably of from 2 to 15 wt. %, more preferred below 10 wt. %.

Typically, the compounds exemplified above in connection with the oxidants also function as bleaching agents. However, this does not exclude to use compounds as bleaching agents which are not mentioned above.

Suitable builders are exemplified by sodium carbonate, sodium sesquicarbonate, sodium sulfate, sodium hydrogencarbonate, phosphates like pentasodium triphosphate, nitrilo triacetic acid or its salt, respectively, citric acid or its salt, respectively, mixtures thereof.

Appropriate disinfectants beside the ones mentioned above in connection with oxidants for use in the composition according to the present invention represent aldehydes such as formaldehyde, glyoxal or glutaraldehyde, phenol derivatives and alcohols or mixtures thereof.

In a preferred embodiment the composition according to the present invention is present in the form of a powder or a solid block. The production of said cleaning powders or solid blocks proceeds according to the procedures mentioned in the state of the art. For example, the powders may be obtained by producing an aqueous slurry of the above composition which is sprayed through nozzles at the upper end of the drying tower under high pressure to form hollow sphere powder.

The composition may be formed into a solid block by melting the acidic source which preferably is placed within a cartridge, and adding the other components of the composition to the melt. It is preferred to add the other components sequentially starting with the anionic surfactant and the nonionic surfactant, followed by the sequestrant(s), the oxidant(s), the solubilizer(s) and afterwards the remaining components, as far as included.

As mentioned above the composition according to the present invention is applied to the solution to be cleaned in the form of its aqueous solution. Said aqueous solution may be formed directly before use or it may be formed beforehand. In case the solution is formed directly before use preferably the composition in the form of the powder or the solid block as specified above will be dispensed in the required amount and then dissolved in the required amount of water to obtain a use solution with a predetermined concentration. However, in case the composition is used in the form of a solid block it is also possible to obtain the use solution by rinsing the solid block with a defined amount of water to obtain the use solution in a predetermined concentration.

In a preferred embodiment the aqueous acidic use solution according to the invention comprises 0.1 to 10 wt. %, preferably 0.5 to 8 wt. % and most preferred 1 to 5 wt. % of the acidic composition based on the total use solution. The rest up to 100 wt. % is water.

The aqueous use solution according to the invention can be prepared as an aqueous solution or in form of a foam.

The aqueous concentrate additionally may contain one or more solvents selected from monohydric or polyhydric alcohols or glycol ether, in particular from ethanol, n-propanol or i-propanol, butanol, glycol, propanediol, butanediol, glycerol, diglycol, propyldiglycol, butyldiglycol, ethylene glycol monomethyl ether, ethylene glycol monoethyl ether, ethylene glycol monopropyl ether, ethylene glycol mono-n-butyl ether, diethylene glycol monomethyl ether, diethylene glycol monoethyl ether, propylene glycol monomethyl ether, propylene glycol monoethyl ether or propylene glycol monopropyl ether, dipropylene glycol monomethyl ether, dipropylene glycol monoethyl ether, methoxy triglycol, ethoxy triglycol, butoxy triglycol, 1-butoxyethoxy-2-propanol, 3-methyl-3-methoxy butanol, propylene glycol mono-t-butyl ether and mixtures thereof.

In order to obtain optimized cleaning results the aqueous cleaning concentrate according to the invention should represent a homogenous solution. Therefore, it is preferred to produce the concentrate according to the invention by dissolving the solid components in water first and add the other components thereto afterwards. Although the sequence of their addition is not particularly limited it is advantageous to add the one or more acidic source first, followed by the addition of the anionic surfactant, the non-ionic surfactant, the sequestrant, the oxidant, the solubilizers and afterwards the remaining components, as far as included. It is also possible to not dissolve the corrosion inhibitor at first but to add it at the end of producing the concentrate. In case the corrosion inhibitor is poorly soluble it can be dissolved for example in an acid first and then mixed with the other ingredients.

Although the employment of the aqueous cleaning concentrate or the use solutions is not limited to metals which are sensitive to corrosion in acidic liquids, one main advantage is its use for such sensitive metal surfaces as with the present aqueous cleaning concentrate or the use solutions no corrosion occurs. In particular the aqueous cleaning concentrate or the use solutions according to the present invention are appropriate to be applied for cleaning the surfaces of soft metals like aluminum, tin, zinc, lead or cadmium, of their alloys or of other metals or alloys such as galvanized steel, especially steel plated with any of those metals. The most preferred metal surfaces are made of aluminum, aluminum alloys or zinc plated steel. The main alloy additions for the aluminum alloys preferably represent copper, magnesium, silicon, manganese and zinc, brass.

In a preferred embodiment of the method according to the present invention the surface to be cleaned is at first brought into contact with the aqueous cleaning concentrate or the use solutions according to the invention. Optionally the contacted surface is rinsed and/or dried afterwards. The contact between the aqueous cleaning concentrate or the use solutions and the metal surface can be obtained by the common methods known in the art such as dipping the metal surface into the aqueous cleaning concentrate or the use solutions or directing the aqueous cleaning concentrate or the use solutions onto the surface, for example by spraying or pouring.

The contact time to obtain sufficient cleaning results may range from a few seconds to several hours. Preferably it ranges from 30 seconds to 2 hours, more preferred from 1 minute to 30 minutes. The contact time may be achieved by providing one contact for the whole contact time or by sequentially contacting the metal surface with the aqueous cleaning concentrate or the use solutions for a specific shorter time wherein the contact time corresponds to the sum of each of the shorter contact periods.

The cleaning results may be improved by agitating the aqueous cleaning concentrate or the use solutions during the whole contact time or during a specific period of the total contact time. In some cases it might also be helpful to raise the temperature of the aqueous cleaning concentrate or the use solutions for example to temperatures of from 20 to 90° C., preferably of from 40 to 60° C.

The method of the present invention may for example refer to the cleaning of outer surfaces made of metal of an article, to its inner surfaces or to both outer and inner surfaces. The cleaning method for outer surfaces is supposed to mainly differ from the cleaning method for inner surfaces with respect to the difficulty to reach the corresponding surface. Typically for cleaning outer surfaces the article remains as it is and the cleaning solution is applied onto the surface to be cleaned. When cleaning inner surfaces for example of an article or a machine, it may be necessary to disassemble the corresponding part of the article or the machine which comprises the surface to be cleaned, as the surface may not be reached by the cleaning solution otherwise. This procedure is often referred to as cleaning out of place (COP). Such a procedure preferably is carried out at ambient temperatures (typically room temperature). However, in some cases it might also be appropriate to raise the temperature up to 60° C.

However, a further way to clean difficult to reach inner surfaces of an article or a machine represents circulating the aqueous cleaning concentrate or the use solutions through the article or the machine, provided that, thereby, the surface to be cleaned gets into contact with the aqueous cleaning concentrate or the use solutions. This procedure is often referred to as cleaning in place (CIP). Such a procedure preferably is carried out at the temperature ranges mentioned above. Both ways of cleaning (COP and CIP) are possible when using the aqueous cleaning concentrate or the use solutions according to the present invention.

The cleaning method according to the present invention may proceed manually or automatically. In case the cleaning proceeds automatically the process can be fully or partly automatic.

The method according to the present invention is applicable to institutional as well as to domestic cleaning purposes.

Examples for surfaces which may be cleaned by the method according to the present invention represent window frames, facades, machines such as (automatic) cleaning machines which contain the specified metal surfaces like dishwashers, scrubber-dryers including walk behind scrubber-dryers or ride-on scrubber dryers, packaging machines, production machines or processing machines in all kinds of industrial fields like food and beverage processing machines, machines used in the production and packaging of beauty care compounds, of pharmaceuticals or of consumer goods, instruments and installations in the medical field, tanks, piping systems, cooling towers, cooling systems, filling machines, metal surfaces which can be found in the household such as pots, (frying) pans, decoration accessories, furniture or parts thereof, frames and all kinds of the corresponding surfaces in vehicles like cars, trucks, ships, boats, bicycles or motorcycles.

The invention will be further elucidated by the following examples without limiting it. All indications of a quantity refer to wt. % unless indicated otherwise.

EXAMPLES

In the following table 1 different compositions of the acidic composition for cleaning surfaces of metal or alloys of metal are shown. These are examples 1 to 5. Furthermore, three comparative examples are described in which one of the components according to claim 1 is missing. In comparative example 6 there is no octane phosphonic acid, in comparative example 7, there is no phosphoric acid ester and in comparative example 8 there is no benzotriazole.

Furthermore, table 1 contains one example of a product of the state of the art which is used as an acidic composition for cleaning surfaces of metal or alloys of metal which are susceptible to corrosion. This is the comparative example 9.

All amounts given in table 1 are in wt. %.

The compositions are prepared by mixing the ingredients in the specified amounts with water and stirring the mixture until a homogenous solution is obtained.

Examples 1, 3, 4 and 5 are examples according to the invention comprising additionally a calcium compound. In example 3, 4 and 5 this is calcium hydroxide and in example 1 it is calcium acetate. However, as will be shown later, a calcium compound is only an optional compound in the compositions according to the invention. Example 2 does not contain any calcium compound.

solutions the compositions according to table 1 were used in a use concentration of 5 wt. %.

The test was carried out at ambient temperature at 20° C. After each submersion the coupons were rinsed with flowing water by using a brush to remove lose material. The painting was removed by a plastic scraper. After drying with a paper towel, the coupons were cleaned with acetone took place. After this, the test coupons were allowed to air-dry over night.

The weight loss of the coupons was calculated by the difference of the weight before the treatment and the weight after the treatment. The weight loss was calculated in weight loss $g/m^2 \times h$. The coupons were placed in the composition for 24 hours.

The amount of weight loss was categorized in three categories. Low weight loss which is <1.00 $g/m^2 \times h$, increased weight loss which is >1.00 to 1.50 $g/m^2 \times h$ and high weight loss which is >1.5 $g/m^2 \times h$.

TABLE 1

| | Compositions in wt-%: | | | | | | | | |
|---|---|---|---|---|---|---|---|---|---|
| | Ex. 1 | Ex. 2 | Ex. 3 | Ex. 4 | Ex. 5 | Comp. Ex. 6 [1)] | Comp. Ex. 7 [2)] | Comp. Ex. 8 [3)] | Comp. Ex. 9 [4)] |
| Water | 43.00 | 45.20 | 44.30 | 47.50 | 42.10 | 44.60 | 45.30 | 44.60 | 46.80 |
| Butyldiglykole | 5.00 | 5.70 | 5.70 | 10.00 | | 5.70 | 5.70 | 5.70 | 3.00 |
| Lauramine oxide (30 wt-% in water) | 8.00 | 7.50 | 7.50 | | 7.00 | 7.50 | 7.50 | 7.50 | 8.00 |
| Triphosphono methyl amine (50 wt-% in water) | | | | | 1.00 | | | | 1.00 |
| Octane phosphonic acid | 0.01 | 0.30 | 0.30 | 0.30 | 0.01 | | 0.30 | 0.30 | |
| Phosphoric acid (75 wt-% in water) | 40.00 | 40.00 | 40.00 | 40.00 | 41.00 | 40.00 | 40.00 | 40.00 | 40.00 |
| N,N' diethyl thiourea | | | | | | | | | 0.20 |
| Quaternary aryl ammonium chloride | | | | | | | | | 1.00 |
| phosphoric acid isotridecylester | | 1.00 | 1.00 | 1.00 | | 1.00 | | 1.00 | |
| Calcium hydroxide | | | 0.90 | 0.90 | 0.90 | 0.90 | 0.90 | 0.90 | |
| Benzotriazole | 0.01 | 0.30 | 0.30 | 0.30 | 0.01 | 0.30 | 0.30 | | |
| phosphoric acid C6-C10 Mono-/ Dialkylester | 2.00 | | | | 1.50 | | | | |
| Calciumacetate | 1.98 | | | | | | | | |
| n-Propanol | | | | | 6.00 | | | | |
| Alkyl polyglycoside | | | | | 0.48 | | | | |

[1)] no octane phosphonic acid
[2)] no phosphoric ester
[3)] no Benzotriazole
[4)] state of art product Material Compatibility on Zinc Galvanized Steel The material compatibility of the compositions according to the invention and the comparative compositions was tested with a zinc galvanized steel. As test specimen standard test plates were used in a size of 5 cm×10 cm. Both sides of the plates were covered by the galvanized zinc coating.

The test plates were cleaned by using a brush with a neutral surfactant base detergent and after that rinsed with water. After drying they were treated with acetone and then the test coupons were allowed to dry over night. The cut edges of the coupons were covered by a chemical resistant painting to eliminate electrochemical effects between the steel and the zinc during the corrosion test. After this, the coupons were again allowed to dry at 50° C. After that, the prepared coupons were placed in a 600 ml. beaker which was filled with 500 ml. test solution so that they were completely immersed. As test Furthermore, the appearance of the test coupons was evaluated by a visual evaluation. It was checked if there were any color changes or surface changes on the test coupons. Test solutions which change the surface appearance or the color significant are not suitable. The following numbering was chosen for the evaluation of the test:

1. no visual changes, low weight loss<1.00 $g/m^2 \times h$=suitable (s)
2. slight visual changes, low weight loss<1.00 $g/m^2 \times h$=suitable (s)/limited suitable (ls)
3. no visual changes, weight loss between 1.00 and 1.50 $g/m^2 \times h$=limited suitable (ls)
4. significant visual changes (oxidation colour change etc.) and high weight loss>1.5 $g/m^2 \times h$=not suitable (ns)
5. sparkle surface, low weight loss<1.00 $g/m^2 \times h$= suitable (s)

6. describes significant colour changes

The results of the material compatibility test with zinc galvanized steel are listed in the following table 2.

TABLE 2

Material compatibility on Zn galvanized steel

| Example | water quality mg/l CaO | Conc. wt-% | Temp. ° C. | Time [h] | Weight loss g/m²h | Evaluation visual | Result |
|---|---|---|---|---|---|---|---|
| Water | 0 | | 20 | 24 | −0.07 | ok | 1/s |
| Phosphoric acid (30%) | 0 | 5 | 20 | 1[1)] | −34.94 | strong corrosion | 4/ns |
| Example 1 | 0 | 5 | 20 | 24 | −0.13 | ok | 2/s |
| Example 2 | 0 | 5 | 20 | 24 | −0.82 | ok | 2/s |
| Example 3 | 0 | 5 | 20 | 24 | −0.86 | ok | 2/s |
| Example 4 | 0 | 5 | 20 | 24 | −0.19 | ok | 2/s |
| Example 5 | 0 | 5 | 20 | 24 | −0.63 | ok | 2/s |
| Comp Example 7 | 0 | 5 | 20 | 15[2)] | −8.13 | strong corrosion | 4/ns |
| Comp Example 6 | 0 | 5 | 20 | 24 | −1.85 | visual 5% Zn loss | 4/ns |
| Comp Example 8 | 0 | 5 | 20 | 24 | −1.64 | visual 5% Zn loss | 4/ns |
| Comp. Example 9 | 0 | 5 | 20 | 24 | −0.76 | Brownish | 2/6/s (brownish) |

[1)] Zn coating completely removed after 2.5 h

[2)] Zn coating completely removed after 15 h

It can be seen that the compounds according to the comparative examples 7 to 9 all show a high weight loss and significant visual changes on the test coupons. In contrast thereto, the examples 1 to 5 according to the invention only show slight visual changes and a low weight loss. Therefore, the material compatibility tests on zinc galvanized steel show that the compositions according to the invention do not show strong corrosion or strong visual changes on the cleaned metal surface.

Furthermore, if the state of the art example 9 is compared with the examples 1 to 5, it can be seen that although the weight loss of the comparative example 9 composition is similar to that of examples 2 to 5, a visual change on the clean surface to a brownish color was observed. This visual change is avoided by using the compounds according to examples 1 to 5.

Material Compatibility of the Composition on Other Metals

In the following experiment the material compatibility of the compositions of Example 2 in table 1 was tested on other metals. Table 3 shows the results for a treatment period of 1 hour, table 4 shows the results for a treatment period of 24 hours. The weight difference is calculated as g/m²×h. The composition was used at a temperature of 20° C. in a use concentration between 2 and 5 wt. %. The experiments were carried out with soft water having a water hardness of 0° d containing 0 mg CaO/L and with hard water of 16° d containing 160 mg CaO/L. The experiments were made in the same way as in table 2 except that standard test coupons of different metals and alloys were used. In the tests described in table 3 and 4 a stainless steel was used, a mild steel containing chrome metal, a galvanized steel, a galvanized hot dip steel as well as aluminum, copper and brass. The results are shown in the following tables 3 and table 4.

TABLE 3

Material compatibility of the composition in example 2 of table1 ono other metals, 1 h tretament

| material | temp. [° C.] | conc. [%] | water hardness [° d] | weight diff.* [g/m² h] | result |
|---|---|---|---|---|---|
| stainless steel (DIN 1.4301 = AISE 304) | 20 | 2 | 0 | 0.00 | suitable |
| | | 5 | 0 | 0.00 | suitable |
| | | 2 | 16 | 0.00 | suitable |
| | | 5 | 16 | 0.00 | suitable |
| mild steel ST37/2 | 20 | 2 | 0 | 0.08 | suitable |
| | | 5 | 0 | 0.09 | suitable |
| | | 2 | 16 | 0.17 | suitable |
| | | 5 | 16 | 0.09 | suitable |
| galvanized steel (hot dip) | 20 | 2 | 0 | −0.02 | suitable |
| | | 5 | 0 | −0.13 | suitable |
| | | 2 | 16 | −0.08 | suitable |
| | | 5 | 16 | −0.09 | suitable |
| Aluminum | 20 | 2 | 0 | 0.09 | suitable |
| | | 5 | 0 | 0.07 | suitable |
| | | 2 | 16 | 0.11 | suitable |
| | | 5 | 16 | 0.03 | suitable |
| Copper | 20 | 2 | 0 | 0.04 | suitable |
| | | 5 | 0 | 0.08 | suitable |
| | | 2 | 16 | 0.07 | suitable |
| | | 5 | 16 | 0.10 | suitable |
| Brass | 20 | 2 | 0 | 0.08 | suitable |
| | | 5 | 0 | 0.11 | suitable |
| | | 2 | 16 | 0.04 | suitable |
| | | 5 | 16 | 0.10 | suitable |

*weight difference per hour after treatment of 1 h

TABLE 4

Material compatibility of the composition in example 2 to other metals, 24 h tretament

| material | temp. [° C.] | conc. [%] | water hardness [° d] | weight diff.* [g/m² h] | result |
|---|---|---|---|---|---|
| stainless steel | 20 | 2 | 0 | 0.00 | suitable |
| (DIN 1.4301 = | 20 | 5 | 0 | 0.00 | suitable |
| AISE 304) | 20 | 2 | 16 | 0.00 | suitable |
| | 20 | 5 | 16 | 0.00 | suitable |
| mild steel | 20 | 2 | 0 | 0.02 | suitable |
| ST37/2 | 20 | 5 | 0 | 0.02 | suitable |
| | 20 | 2 | 16 | 0.03 | suitable |
| | 20 | 5 | 16 | 0.04 | suitable |
| galvanized steel | 20 | 2 | 0 | −0.32 | suitable |
| (hot dip) | 20 | 5 | 0 | −0.82 | suitable |
| | 20 | 2 | 16 | −0.23 | suitable |
| | 20 | 5 | 16 | −0.63 | suitable |
| Aluminum | 20 | 2 | 0 | 0.00 | suitable |
| | 20 | 5 | 0 | 0.01 | suitable |
| | 20 | 2 | 16 | 0.01 | suitable |
| | 20 | 5 | 16 | 0.01 | suitable |
| Copper | 20 | 2 | 0 | 0.01 | suitable |
| | 20 | 5 | 0 | 0.02 | suitable |
| | 20 | 2 | 16 | 0.01 | darkened |
| | 20 | 5 | 16 | 0.01 | darkened |
| Brass | 20 | 2 | 0 | 0.01 | suitable |
| | 20 | 5 | 0 | 0.03 | suitable |
| | 20 | 2 | 16 | 0.01 | suitable |
| | 20 | 5 | 16 | 0.01 | suitable |

*weight difference per hour after treatment of 24 h

From table 3 and 4 can be seen that the composition according to example 2 of the invention has a high material compatibility also with other metals or alloys and is suitable for the cleaning of surfaces of these metals or alloys.

The results of the experiments show that the compositions according to the examples 1 to 5 have an excellent inhibition of corrosion with zinc galvanized steel and also other metals and alloys. Compared to the current standard composition (comparative example 9) identical or even better corrosion inhibition results are achieved. Furthermore, examples 1 to 5 can also be used as a foam and it is possible to prepare foams from these compositions without any difficulties.

Furthermore, it is important to emphasize that the compositions according to the invention have a much better toxicological profile compared to the current products. The compositions according to the invention do not contain a quaternary ammonium compound. Quaternary ammonium compounds have the disadvantage that the surfaces which are cleaned with compositions containing this compound show a visual change to a brownish color. A further disadvantage of this compound is that layers are formed on the clean surfaces which are difficult to remove. These layers are very critical in food producing plants due to hygiene standards and/or contamination of food stuff which is processed in the plant.

Furthermore, the compositions according to the invention do not contain any substances which are classified as potential carcinogenic compounds like sulfur containing organic substances or metal organic substances.

The invention claimed is:

1. An acidic composition for cleaning surfaces of metal or alloys comprising:

i) an ester of phosphoric acid, diphosphoric acid or polyphosphoric acid, ii) a benzotriazole derivative of the general formula:

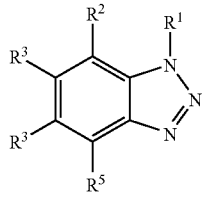

in which each of the groups $R^1$, $R^2$, $R^3$, $R^4$ and $R^5$ is the same or different and is a hydrogen atom, an alkyl group, an alkenyl group, or an acyl group;

iii) a phosphonic acid of the general formula $R^6$—PO—$(OH)_2$ in which the group $R^6$ is alkyl group, alkenyl group, aryl group, or arylalkyl group; and iv) an acidic source, wherein the composition does not contain metal organic substances and the composition has a pH lower than 3.

2. The composition of claim 1, wherein the aqueous liquid composition comprises based on the total composition i) 0.1-10 wt-% of the ester of phosphoric acid, diphosphoric acid or polyphosphoric acid, ii) 0.01-2 wt-% of the benzotriazole derivative iii) 0.01-2 wt-% of the phosphonic acid, and iv) 10-70 wt-% of the acidic source.

3. The composition of claim 1, wherein the ester is a monoester or diester of phosphoric acid.

4. The composition of claim 1, wherein the ester is a monoalkyl ester or dialkyl ester of phosphoric acid.

5. The composition of claim 1, wherein the ester is a mono-$C_4$-$C_{15}$ alkyl ester or di-$C_4$-$C_{15}$ alkyl ester of phosphoric acid.

6. The composition of claim 1, wherein each of the groups $R^1$, $R^2$, $R^3$, $R^4$ and $R^5$ in the benzotriazole independently selected from hydrogen atom or a $C_1$-$C_4$ alkyl group.

7. The composition of claim 1, wherein $R^6$ is a $C_5$-$C_{12}$ alkyl group.

8. The composition of claim 1, further comprising a calcium compound.

9. The composition of claim 8, wherein the calcium compound is selected from the group consisting of calcium chloride, calcium bromide, calcium acetate, calcium hydroxide, calcium oxide and mixtures thereof.

10. The composition of claim 1, further comprising a magnesium compound.

11. The composition of claim 10, wherein the magnesium compound is selected from the group consisting of magnesium chloride, magnesium bromide, magnesium acetate, magnesium sulfate, magnesium hydroxide, magnesium oxide and mixtures thereof.

12. The composition of claim 1, wherein the acidic source is an organic acid, inorganic acid, or mixture thereof.

13. The composition of claim 1, wherein the composition does not contain quaternary ammonium compounds.

14. The composition of claim 1, wherein the composition does not contain sulfur organic substances.

15. A method of cleaning a metal surface comprising:

(a) applying to the surface, a composition comprising:

i) an ester of phosphoric acid, diphosphoric acid or polyphosphoric acid, ii) a benzotriazole derivative of the general formula:

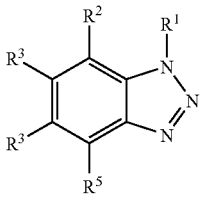

in which each of the groups $R^1$, $R^2$, $R^3$, $R^4$ and $R^5$ is the same or different and is a hydrogen atom, an alkyl group, an alkenyl group, or an acyl group;

iii) a phosphonic acid of the general formula $R^6$—PO—$(OH)_2$ in which the group $R^6$ is alkyl group, alkenyl group, aryl group, or arylalkyl group; and iv) an acidic source;

(b) cleaning the surface; and (c) removing the composition from the surface by rinsing or drying, wherein the composition does not contain metal organic substances and the composition has a pH lower than 3.

16. The method of claim 15, wherein the surface is selected from the group consisting of zinc galvanized steel, aluminum, brass, stainless steel, and copper.

17. The method of claim 15, wherein the cleaning is a clean-in-place operation.

* * * * *